US007574352B2

(12) United States Patent
Quatieri, Jr.

(10) Patent No.: US 7,574,352 B2
(45) Date of Patent: Aug. 11, 2009

(54) 2-D PROCESSING OF SPEECH

(75) Inventor: Thomas F. Quatieri, Jr., Newtonville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 655 days.

(21) Appl. No.: 10/244,086

(22) Filed: Sep. 13, 2002

(65) Prior Publication Data

US 2004/0054527 A1 Mar. 18, 2004

Related U.S. Application Data

(60) Provisional application No. 60/409,095, filed on Sep. 6, 2002.

(51) Int. Cl.
*G10L 11/04* (2006.01)

(52) U.S. Cl. ..... 704/207

(58) Field of Classification Search ..... 704/228, 704/205–207

See application file for complete search history.

(56) References Cited

U.S. PATENT DOCUMENTS 5,377,302 A 12/1994 Tsiang
6,061,648 A * 5/2000 Saito ..... 704/219

FOREIGN PATENT DOCUMENTS

GB 2 280 827 2/1995

OTHER PUBLICATIONS

Qiu et al. "Pitch determination of noisy speech using wavelet transform in time and frequency domains", Oct. 19-21, 1993, IEEE TENCON '93, Beijing, vol. 3, pp. 337-340.*
Openshaw et al. "Noise robust estimate of speech dynamics for speaker recognition", Proc. ICSLP 96, 1996, pp. 925-928.*
Mellor et al. "Noise masking in a transform domain", ICASSP-93, vol. 2, 1993, pp. 87-90.*
Hess, W. "An algorithm for digital time-domain pitch period determination of speech signals and its application to detect F0 dynamics in VCV utterances", Apr. 1976, ICASSP '76, vol. 1, pp. 322-325.*
Terez, D.E., "Robust pitch determination using nonlinear state-space embedding", vol. 1, 2002, ICASSP '02, pp. 1-345-1-348.*

(Continued)

*Primary Examiner*—Angela A Armstrong
(74) *Attorney, Agent, or Firm*—Hamilton, Brook, Smith & Reynolds, P.C.

(57) ABSTRACT

Acoustic signals are analyzed by two-dimensional (2-D) processing of the one-dimensional (1-D) speech signal in the time-frequency plane. The short-space 2-D Fourier transform of a frequency-related representation (e.g., spectrogram) of the signal is obtained. The 2-D transformation maps harmonically-related signal components to a concentrated entity in the new 2-D plane (compressed frequency-related representation). The series of operations to produce the compressed frequency-related representation is referred to as the "grating compression transform" (GCT), consistent with sine-wave grating patterns in the frequency-related representation reduced to smeared impulses. The GCT provides for speech pitch estimation. The operations may, for example, determine pitch estimates of voiced speech or provide noise filtering or speaker separation in a multiple speaker acoustic signal.

40 Claims, 15 Drawing Sheets

OTHER PUBLICATIONS

Kinsner, W. "Speech and image signal compression with wavelets", WESCANEX 93, May 17-18, 1993, pp. 368-375.*

Nawab, S.H. et al., "Signal Reconstruction from Short-Time Fourier Transform Magnitude," *IEEE Transactions on Acoustics, Speech, and Signal Processing*, vol. ASSP-31, No. 4, Aug. 1983, pp. 986-998.

Quatieri, T.F. et al., "Frequency sampling of short-time Fourier-transform magnitude for signal reconstruction," *J. Opt. Soc. Am.*, 73:11 (1523-1526) Nov. 1983.

Swartz, B. and N. Magotra, "Feature Extraction for Automatic Speech Recognition (ASR) ," *Thirtieth Asilomar Conference on Signals, Systems & Computers*, Nov. 3-6, 1996, pp. 748-752.

Ahmadi, M. et al., "Phoneme Recognition Using Speech Image (Spectrogram) ," *Proceedings of ICSP '96*, pp. 675-677.

Tanaka, Y. and H. Kimura, "Low-Bit-Rate Speech Coding Using a Two-Dimensional Transform of Residual Signals and Waveform Interpolation," *Proc. 1994 IEEE International Conference on Acoustics, Speech and Signal Processing*, Apr. 1994, pp. I-173-I-176.

Terada, T. et al., "Nonstationary Waveform Analysis and Synthesis Using Generalized Harmonic Analysis," *Proceedings of the IEEE-SP International Symposium on Time-Frequency and Time-Scale Analysis*, Oct. 25-28, 1994, pp. 429-432.

Ariki, Y. et al., "Acoustic Noise Reduction by Two Dimensional Spectral Smoothing and Spectral Amplitude Transformation," *ICASSP 86, Tokyo*, pp. 97-100.

Woods, J.W. and V.K. Ingle, "Two Dimensional Processing of Spectrogram Data," *Proc. 1978 IEEE International Conference on Acoustics, Speech and Signal*, Apr. 10-12, 1978, pp. 39-42.

Chan, C.P. et al., "Two-Dimesional Multi-Resolution Analysis of Speech Signals and its Application to Speech Recognition," *Proceedings of 1999 IEEE International Conference on Acoustics, Speech, and Signal Processing*, vol. 1, pp. 405-408.

Quatieri, T., "2-D Processing of Speech With Application to Pitch Estimation", *Int. Conf. On Spoken Language Processing ICSLP '02*, Sep. 16-20, 2002, XP002270661.

Hinich, M., et al., "Bispectral Analysis of Speech", *Applied Research Laboratories, The University of Texas at Austin*, pp. 357-360.

Van De Wouwer, G., et al., "Voice Recognition From Spectrograms: A Wavelet Based Approach", *World Scientific Publishing Company*, Apr. 1997, pp. 165-172, XP008027609.

Kitamura, T., et al., "Pitch Determination by Two-Dimensional Cepstrum", *Bull. P.M.E.* (*T.I.T.*), No. 37, 1976, pp. 25-32, XP008027607.

R.J. McAulay and T.F. Quatieri, "Pitch estimation and voicing detection based on a sinusoidal speech model," Proc. Int. Conf. on Acoustics, Speech, and Signal Processing, Albuquerque, N.M., pp. 249-252, 1990).

Chi, T., et al., "Spectro-remporal modulation transfer functions and speech intelligibility," *J. Acoust. Soc. Am.,* 106(5): 2719-2732 (1999).

* cited by examiner

Amplitude
Frequency (Hz)
Time (s)
Window 130
Compressed Frequency Related-Representation 120

2-D PROCESSING OF SPEECH

RELATED APPLICATION(S)

This application claims the benefit of U.S. Provisional Application titled "2-D PROCESSING OF SPEECH" by Thomas F. Quatieri, Jr., Ser. No. 60/409,095, filed Sep. 6, 2002. The entire teaching of the above application is incorporated herein by reference.

GOVERNMENT SUPPORT

The invention was supported, in whole or in part, by the United States Government's Technical Support Working Group under Air Force Contract No. F19628-00-C-0002. The Government has certain rights in the invention.

BACKGROUND OF THE INVENTION

Conventional processing of acoustic signals (e.g., speech) analyzes a one dimensional frequency signal in a frequency-time domain. Sinewave-base techniques (e.g., the sine-wave-based pitch estimator described in R. J. McAulay and T. F. Quatieri, "Pitch estimation and voicing detection based on a sinusoidal model," Proc. Int. Conf. on Acoustics, Speech, and Signal Processing, Albuquerque, N.Mex., pp. 249–252, 1990) have been used to estimate the pitch of voiced speech in this frequency-time domain. Estimation of the pitch of a speech signal is important to a number of speech processing applications, including speech compression codecs, speech recognition, speech synthesis and speaker identification.

SUMMARY OF THE INVENTION

Conventional pitch estimation techniques often suffer when presented with noisy environments or high pitch (e.g., women's) speech. It has been observed that 2-D patterns in images can be mapped to dots, or concentrated pulses, in a 2-D spatial frequency domain. Time related frequency representations (e.g., spectrograms) of acoustic signals contain 2-D patterns in images. An embodiment of the present invention maps time related frequency representations of acoustic signals to concentrated pulses in a 2-D spatial frequency domain. The resulting compressed frequency-related representation is then processed. The series of operations to produce the compressed frequency-related representation is referred to as the "grating compression transform" (GCT), consistent with sine-wave grating patterns in the spectrogram reduced to smeared impulses. The processing may, for example, determine pitch estimates of voiced speech or provide noise filtering or speaker separation in a multiple speaker acoustic signal.

A method of processing an acoustic signal is provided that prepares a frequency-related representation of the acoustic signal over time (e.g., spectrogram, wavelet transform or auditory transform) and computes a two dimensional transform, such as a 2-D Fourier transform, of the frequency-related representation to provide a compressed frequency-related representation. The compressed frequency-related representation is then processed. The acoustic signal can be a speech signal and the processing may determine a pitch of the speech signal. The pitch of the speech signal can be determined from computing the inverse of a distance between a peak of impulses and an origin. Windowing (e.g., Hamming windows) of the spectrogram can be used to further improve the calculation of the pitch estimate; likewise a multiband analysis is performed for further improvement.

Processing of the compressed frequency-related representation may filter noise from the acoustic signal. Processing of the compressed frequency-related representation may distinguish plural sources (e.g., separate speakers) within the acoustic signal by filtering the compressed frequency-related representation and performing an inverse transform.

An embodiment of the present invention produces pitch estimation on par with conventional sinewave-based pitch estimation techniques and performs better than conventional sinewave-based pitch estimation techniques in noisy environments. This embodiment of the present invention for pitch estimation also performs well with high pitch (e.g., women's) speech.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
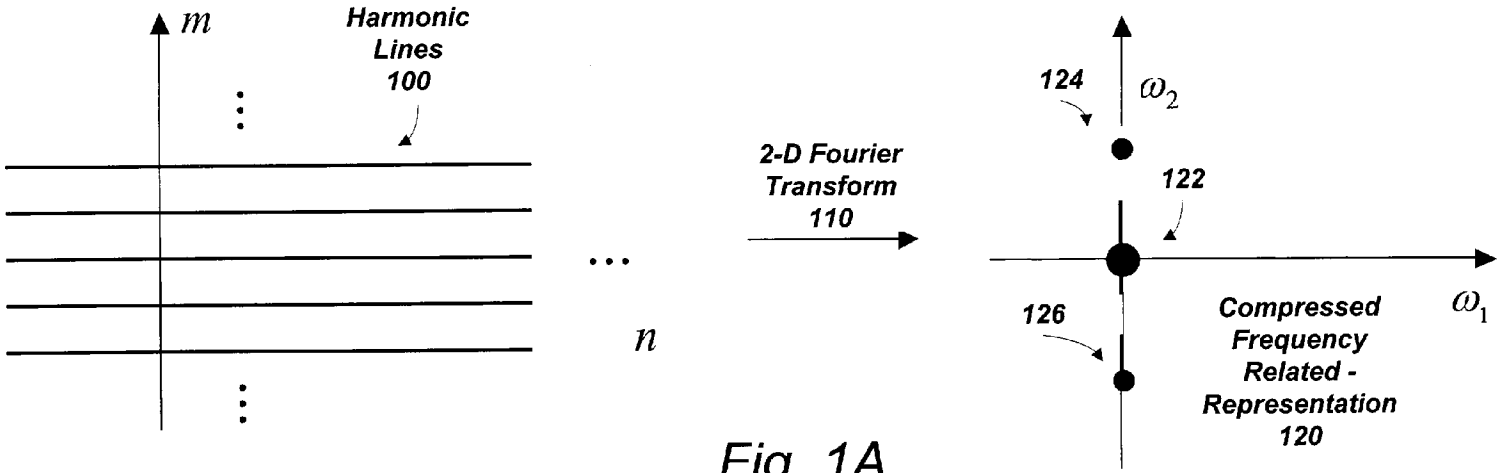
FIGS. 1A and 1B are schematic diagrams of harmonic line configurations, 2-D Fourier transforms and compressed frequency-related representations.

A description of preferred embodiments of the invention follows.

Human speech produces a vibration of air that creates a complex sound wave signal comprised of a fundamental frequency and harmonics. The signal can be processed over successive time segments using a frequency transform (e.g., Fourier transform) to produce a one-dimensional (1-D) representation of the signal in a frequency/magnitude plane. Concentrations of magnitudes can be compressed and the signal can then be represented in a time/frequency plane (e.g., a spectrogram).

Two-dimensional (2-D) processing of the one-dimensional (1-D) speech signal in the time-frequency plane is used to estimate pitch and provide a basis for noise filtering and speaker separation in voiced speech. Patterns in a 2-D spatial domain map to dots (concentrated entities) in a 2-D spatial frequency domain ("compressed frequency-related representation") through the use of a 2-D Fourier transform. Analysis of the "compressed frequency-related representation" is performed. Measuring a distance from an origin to a dot can be used to compute estimated pitch. Measuring the angle of the line defined by the origin and the dot reveals the rate of change of the pitch over time. The identified pitches can then be used to separate multiple sources within the acoustic signal.

A short-space 2-D Fourier transform of a narrowband spectrogram of an acoustic signal maps harmonically-related signal components to a concentrated entity in the a new 2-D spatial frequency plane domain (compressed frequency-related representation). The series of operations to produce the compressed frequency-related representation is referred to as the "grating compression transform" (GCT), consistent with sine-wave grating patterns in the spectrogram reduced to smeared impulses. The GCT forms the basis of a speech pitch estimator that uses the radial distance to the largest peak in the GCT plane. Using an average magnitude difference between pitch-contour estimates, the GCT-based pitch estimator compares favorably to a sine-wave-based pitch estimator for all-voiced speech in additive white noise.

An embodiment of the present invention provides a new method, apparatus and article of manufacture for 2-D processing of 1-D speech signals. This method is based on merging a sinusoidal signal representation with 2-D processing, using a transformation in the time-frequency plane that significantly increases the concentration of related harmonic components. The transformation exploits coherent dynamics of the sine-wave representation in the time-frequency plane by applying 2-D Fourier analysis over finite time-frequency regions. This "grating compression transform" (GCT) method provides a pitch estimate as the reciprocal radial distance to the largest peak in the GCT plane. The angle of rotation of this radial line reflects the rate of change of the pitch contour over time.

A framework for the method, apparatus and article of manufacture is developed by considering a simple view of the narrowband spectrogram of a periodic speech waveform. The harmonic line structure of a signal's spectrogram is modeled over a small region by a 2-D sinusoidal function sitting on a flat pedestal of unity. For harmonic lines horizontal to the time axis, i.e., for no change in pitch, we express this model by the 2-D sequence (assuming sampling to discrete time and frequency)

$$x[n,m]=1+\cos(\omega_g m) \tag{1}$$

where n denotes discrete time and m discrete frequency, and $\omega_g$ is the (grating) frequency of the sine wave with respect to the frequency variable m. The 2-D Fourier transform of the 2-D sequence in Equation (1) is given by (with relative component weights)

$$X(\omega_1,\omega_2)=2\delta(\omega_1,\omega_2)+\delta(\omega_1,\omega_2-\omega_g)+\delta(\omega_1,\omega_2+\omega_g) \tag{2}$$

consisting of an impulse at the origin corresponding to the flat pedestal and impulses at $\pm\omega_g$ corresponding to the sine wave. The distance of the impulses from the origin along the frequency axis $\omega_2$ is determined by the frequency of the 2-D sine wave. For a voiced speech signal, this distance corresponds to the speaker's pitch.

Figure 1B:
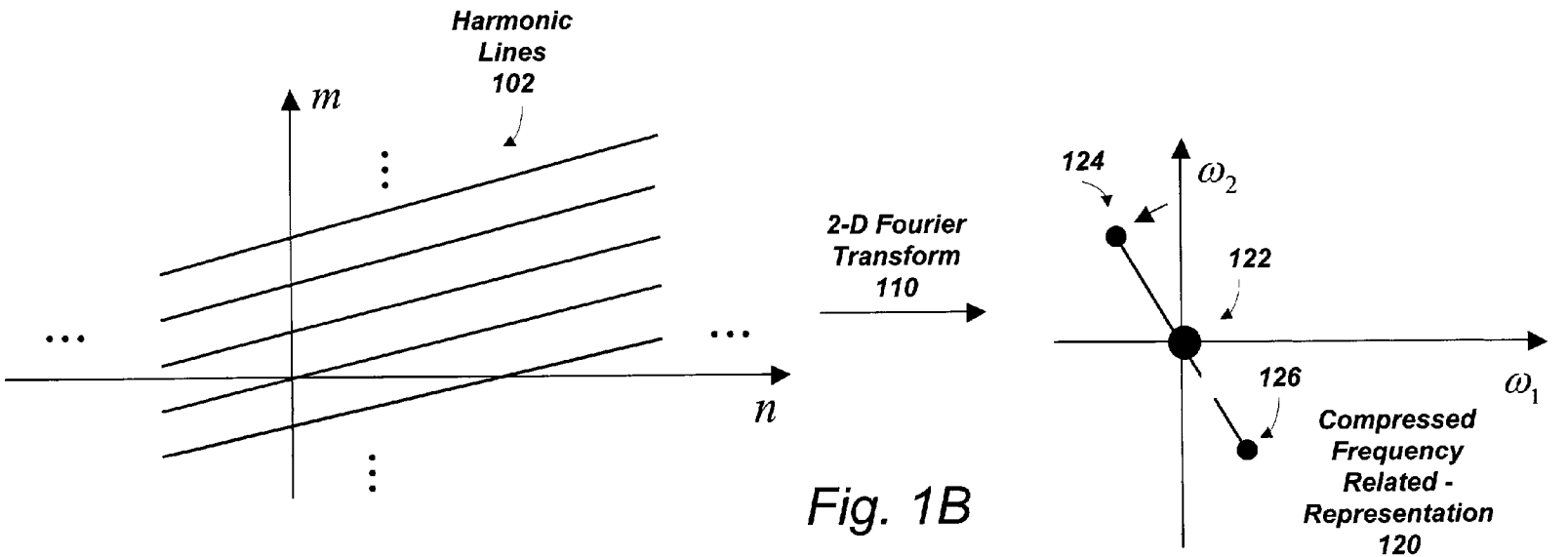

FIG. 1A schematically illustrates a model 2-D sequence and its transform. Harmonic lines 100 (unchanging pitch) are transformed using a 2-D Fourier transform 110 into the compressed frequency-related representation 120. More generally, the harmonic line structure is at an angle relative to the time axis, reflecting the changing pitch of the speaker for voiced speech. For the idealized case of rotated harmonic lines, the 2-D Fourier transform is obtained by rotating the two impulses of Equation (2), as illustrated in FIG. 1B showing harmonic lines 102 (changing pitch). Constant amplitude along harmonic lines is assumed in these models.

The spectrogram models of FIGS. 1A and 1B correspond to 2-D sine waves extrapolated infinitely in both the time (n) and frequency (m) dimensions and the results of the 2-D Fourier transforms, the compressed frequency-related representations 120, are given by three impulses. One impulse is at the origin 122 and two impulses (124, 126) are situated along a line whose location is determined by the speaker's pitch and rate of pitch change. Generally, for speech signals, uniformly spaced, constant-amplitude, rotated harmonic line structure holds approximately only over short regions of the time-frequency plane because the line spacing, angle, and amplitude changes as pitch and the vocal tract change. A 2-D window, therefore, is applied prior to computing the 2-D Fourier transform. This results in smearing the impulsive nature of the idealized transform, i.e., the 2-D transform in Equation (2) becomes a scaled version of:

$$\hat{X}(\omega_1,\omega_2)=2W(\omega_1,\omega_2)+W(\omega_1,\omega_2-\omega_g)+W(\omega_1,\omega_2+\omega_g) \tag{3}$$

where $W(\omega_1,\omega_2)$ is the Fourier transform of the 2-D window. Nevertheless, this 2-D representation provides an increased signal concentration in the sense that harmonically-related components are "squeezed" into smeared impulses. The spectrogram operation, followed by the magnitude of the short-space 2-D Fourier transform is referred to as the "grating compression transform" (GCT), consistent with sine-wave grating patterns in the spectrogram being compressed to concentrated regions in the 2-D GCT plane.

Figures 2A, 2B, 2C:
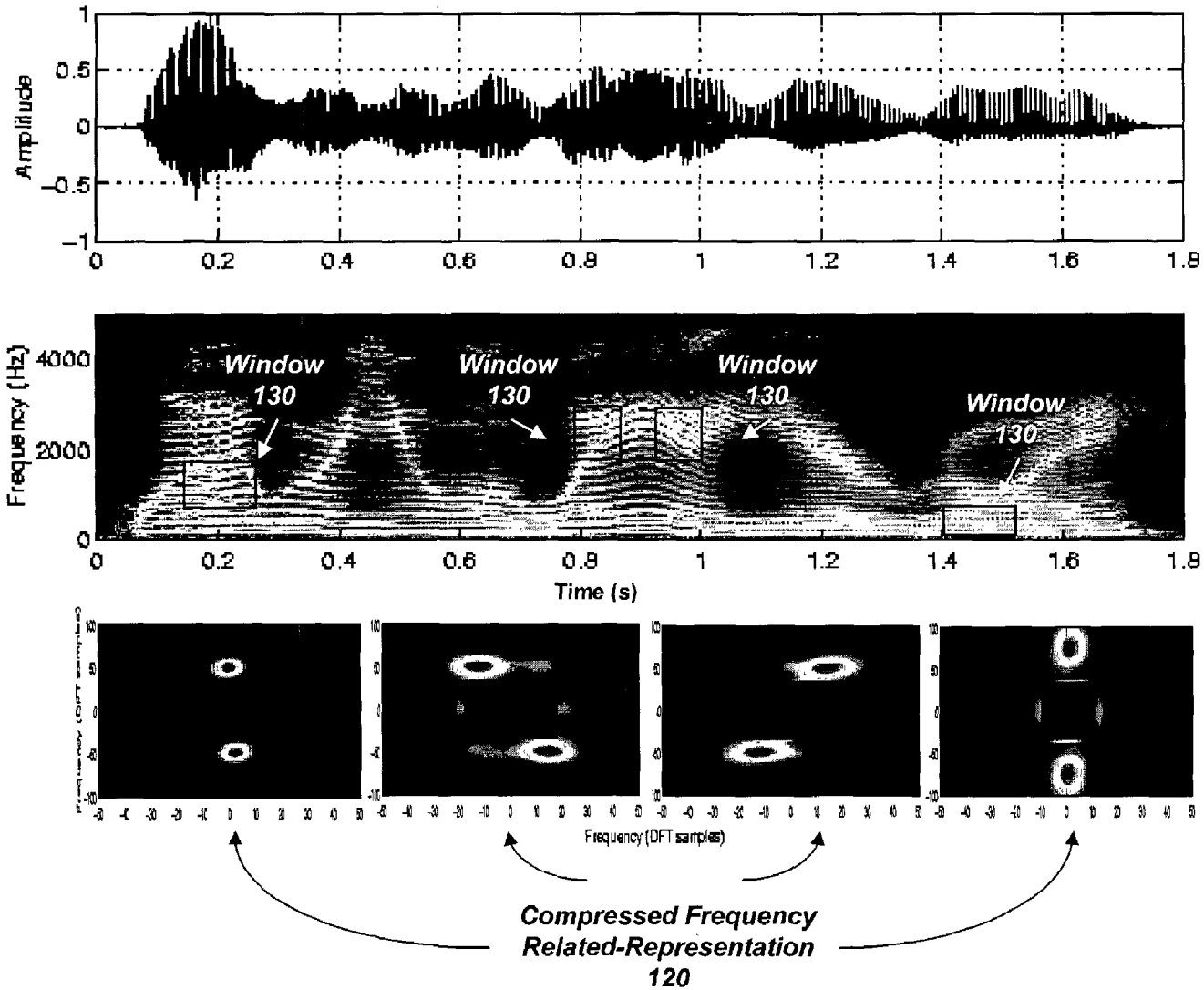
FIGS. 2A, 2B and 2C illustrate a waveform, a narrowband spectrogram, and a compressed frequency-related representation, or GCT, respectively, for an all-voiced passage.

FIGS. 2A, 2B and 2C illustrate a waveform, a narrowband spectrogram, and a compressed frequency-related representation, or GCT, respectively, for an all-voiced passage from a female speaker. The all-voiced speech passage is: "Why were you away a year Roy?" FIG. 2A illustrates the time signal, FIG. 2B illustrates a spectrogram of FIG. 2A and FIG. 2C illustrates a GCT at four different time-frequency window locations. The GCTs, from left to right, correspond to the 2-D analysis windows at increasing time locations that are superimposed on the spectrogram. In one embodiment of the present invention a 20-ms Hamming window is applied to the waveform at a 10-ms frame interval and a 512-point FFT is applied to obtain the spectrogram. Each 2-D analysis window size is chosen to result in harmonic lines that, under the window, appear roughly uniformly spaced with constant amplitude and are characterized by a single angle, so as to approximately follow the model in FIGS. 1A and 1B. Typically, the 2-D window is selected to be narrower in time and wider in frequency as the frequency increases, reflecting the nature of the changing harmonic line structure. The 2-D analysis window is also tapered, given by the product of two 1-D Hamming windows, to avoid abrupt boundary effects. The GCTs in FIG. 2C correspond to four different 2-D time-frequency analysis windows, superimposed on the spectrogram. The DC region of each GCT (i.e., a sample set near its origin, is removed for improving clarity of the smeared impulses of interest. Each GCT shows an energy concentration whose distance from the origin is a function of the pitch under the 2-D analysis window and whose rotation from the frequency axis is a function of the pitch rate of change. Therefore, the illustrated GCTs approximately follow the model of the 2-D function in Equation (3) and its rotated generalization, with radial-line peaks and angles corresponding to different fundamental frequencies and frequency modulations.

Figure 3A:
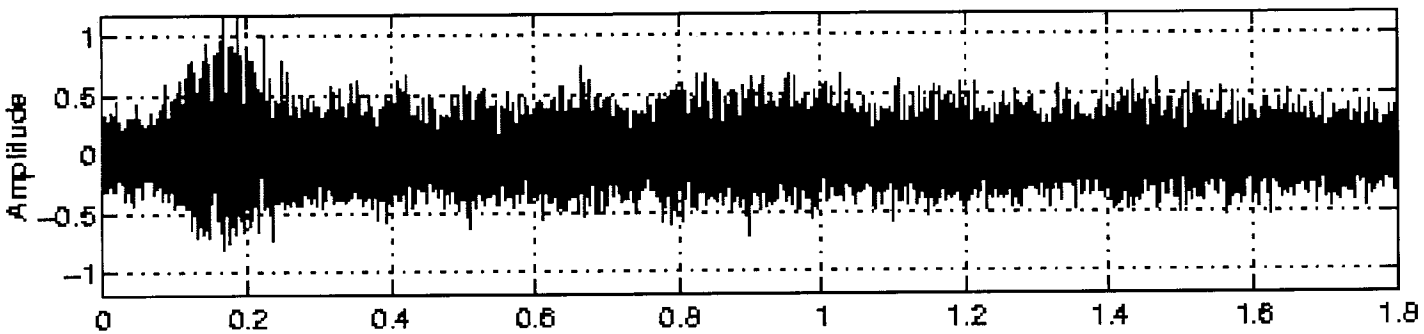
FIGS. 3A, 3B and 3C illustrate a waveform, narrowband spectrogram, and a compressed frequency-related representation, or GCT, for the all-voiced passage of FIGS. 2A, 2B and 2C, with an additive white Gaussian noise at an average signal-to-noise ratio of about 3 dB.
Figure 3B:
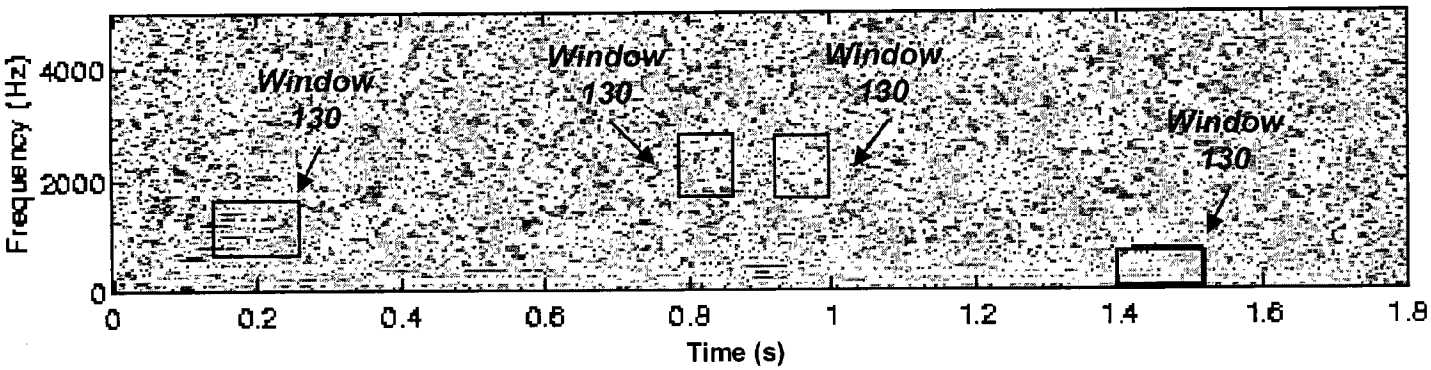
Figure 3C:
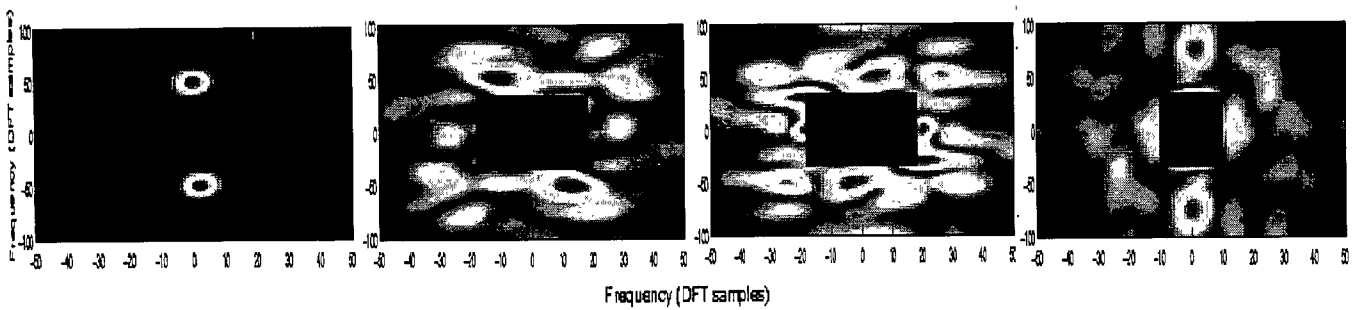

FIGS. 3A, 3B and 3C illustrate a waveform, narrowband spectrogram, and a compressed frequency-related representation, or GCT, for the all-voiced passage of FIGS 2A, 2B and 2C, with an additive white Gaussian noise at an average signal-to-noise ratio of about 3 dB. The energy concentration of the GCT is typically preserved at roughly the same location as for the clean case of FIGS. 2A, 2B and 2C. However, when noise dominates the signal in the time-frequency plane, so that little harmonic structure remains within the 2-D window, the energy concentration deteriorates, as seen for example in the vicinity of 0.95 s and 2000 Hz.

An embodiment of the present invention uses the information shown in FIGS. 1A and 1B and the GCT of the speech examples in FIGS. 2A, 2B, 2C, and 3A, 3B, 3C to provide the basis for a pitch estimator. The pitch estimate of the speaker is reciprocal to the distance from the origin to the peak in the GCT. Specifically, because this radial distance is an estimate of the period of the periodic waveform, we can estimate the pitch in hertz at time n as $$\omega_o[n]=f_s/\overline{\omega}_g[n] \tag{4}$$

where $f_s$ is the sampling rate and $\overline{\omega}_g[n]$ is the distance (in DFT samples) from the origin to the GCT peak.

Figure 4A:
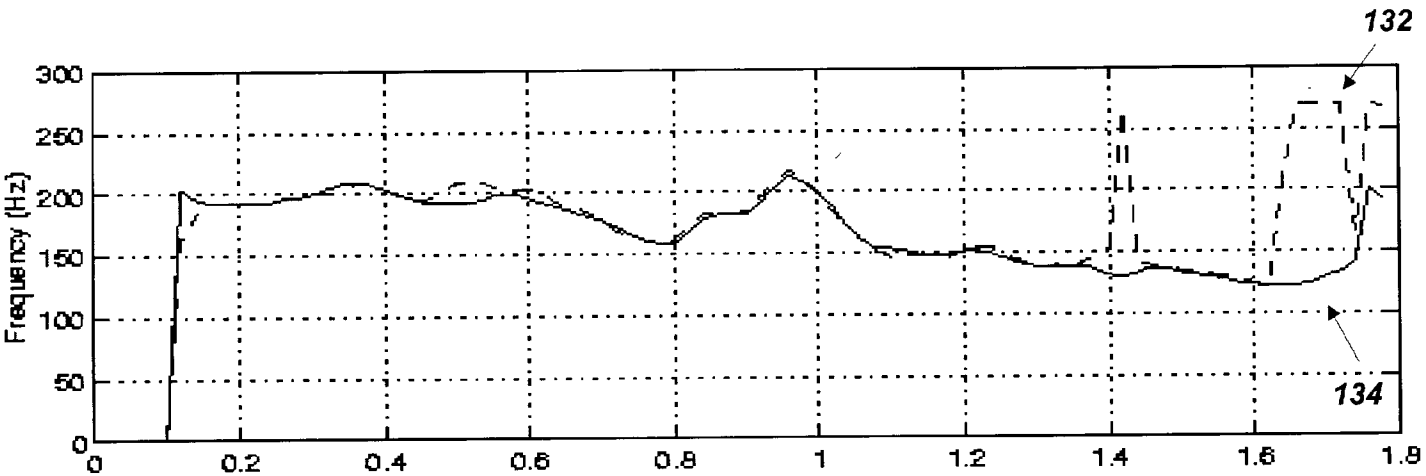
FIG. 4A illustrates the pitch contour estimation from a 2-D GCT without white Gaussian noise, and with white Gaussian noise.
Figure 4B:
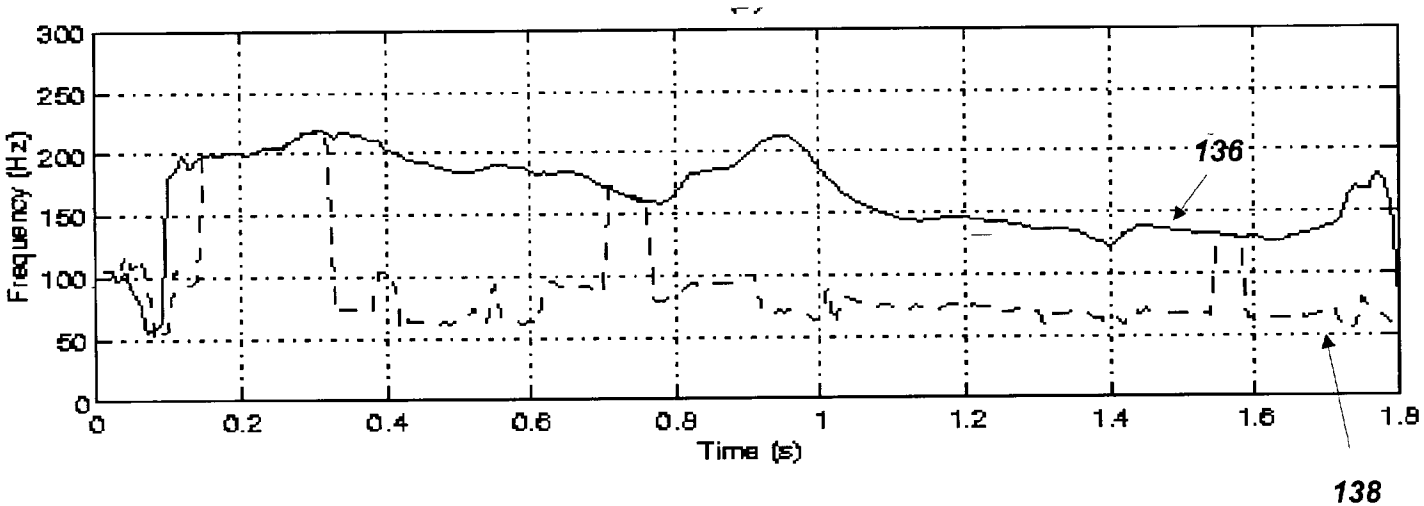
FIG. 4B illustrates the pitch contour estimation from a sine-wave-based pitch estimator without white Gaussian noise and with white Gaussian noise.

The pitch contour of the all-voiced female speech in FIG. 2A, 2B, 2C was estimated using the GCT-based estimator of Equation (4) and is shown in FIG. 4A (solid curve 134). The 2-D analysis window is slid along the speech spectrogram at a 20-ms frame interval at the frequency location given by the right-most 2-D window in FIG. 2C. FIG. 4B (solid curve 136) shows the pitch estimate of the same waveform derived from a sine-wave-based pitch estimator that fits a harmonic model to the short-time Fourier transform on each (10-ms) frame. FIG. 4A illustrates the pitch contour estimation from a 2-D GCT without white Gaussian noise (solid curve 136) and with white Gaussian noise (dashed curve 138). FIG. 4B illustrates the pitch contour estimation from a sine-wave-based pitch estimator without white Gaussian noise (solid curve 134) and with white Gaussian noise (dashed curve 132). FIGS. 4A and 4B show the closeness of the two estimates.

For a speech waveform in a white noise background (e.g., FIG. 3A), typically, the noise is scattered about the 2-D GCT plane, while the speech harmonic structure remains concentrated. Consequently, an embodiment of the present invention exploits this property in order to provide for pitch estimation in noise. The pitch contour of the female speech in FIG. 3A (the noisy counterpart to FIG. 2A) was estimated using the 2-D GCT-based estimator and is shown in FIG. 4A (dashed curve 132). FIG. 4B shows the pitch estimate of the same waveform derived from a sine-wave-based pitch estimator (dashed curve 138), illustrating a greater robustness of the estimator based on the 2-D GCT, likely due to the coherent integration of the 2-D Fourier transform over time and frequency.

In order to better understand the performance of the GCT-based pitch estimator, the average magnitude difference between pitch-contour estimates with and without white Gaussian noise are determined. The error measure is obtained for two all-voiced, 2-s male passages and two all-voiced, 2-s female passages under a 9 dB and 3 dB white-Gaussian-noise condition. The initial and final 50 ms of the contours are not included in the error measure to reduce the influence of boundary effects. Table 1 compares the performance of the GCT- and the sine-wave-based estimators under these conditions. The average magnitude error (in dB) in GCT and sine-wave-based pitch contour estimates for clean and noisy all-voiced passages is shown. The two passages "Why were you away a year Roy?" and "Nanny may know my meaning." from two male and two female speakers were used under noise conditions 9 dB and 3 dB average signal-to-noise ratio. As before, the two estimators provide contours that are visually close in the no-noise condition. It can be seen that, especially for the female speech under the 3 dB condition, the GCT-based estimator compares favorably to the sine-wave-based estimator for the chosen error.

TABLE 1

| | Average Magnitude Error | | | |
|---|---|---|---|---|
| | FEMALES | | MALES | |
| | 9 dB | 3 dB | 9 dB | 3 dB |
| GCT | 0.5 | 6.7 | 0.9 | 6.7 |
| SINE | 5.8 | 40.5 | 2.6 | 12.8 |

An embodiment of the present invention produces a 2-D transformation of a spectrogram that can map two different harmonic complexes to separate transformed entities in the GCT plane, providing for two-speaker pitch estimation. The framework for the approach is a view of the spectrogram of the sum of two periodic (voiced) speech waveforms as the sum of two 2-D sine waves with different harmonic spacing and rotation (i.e., a two-speaker generalization of the single-sine model discussed above).

Figure 5:
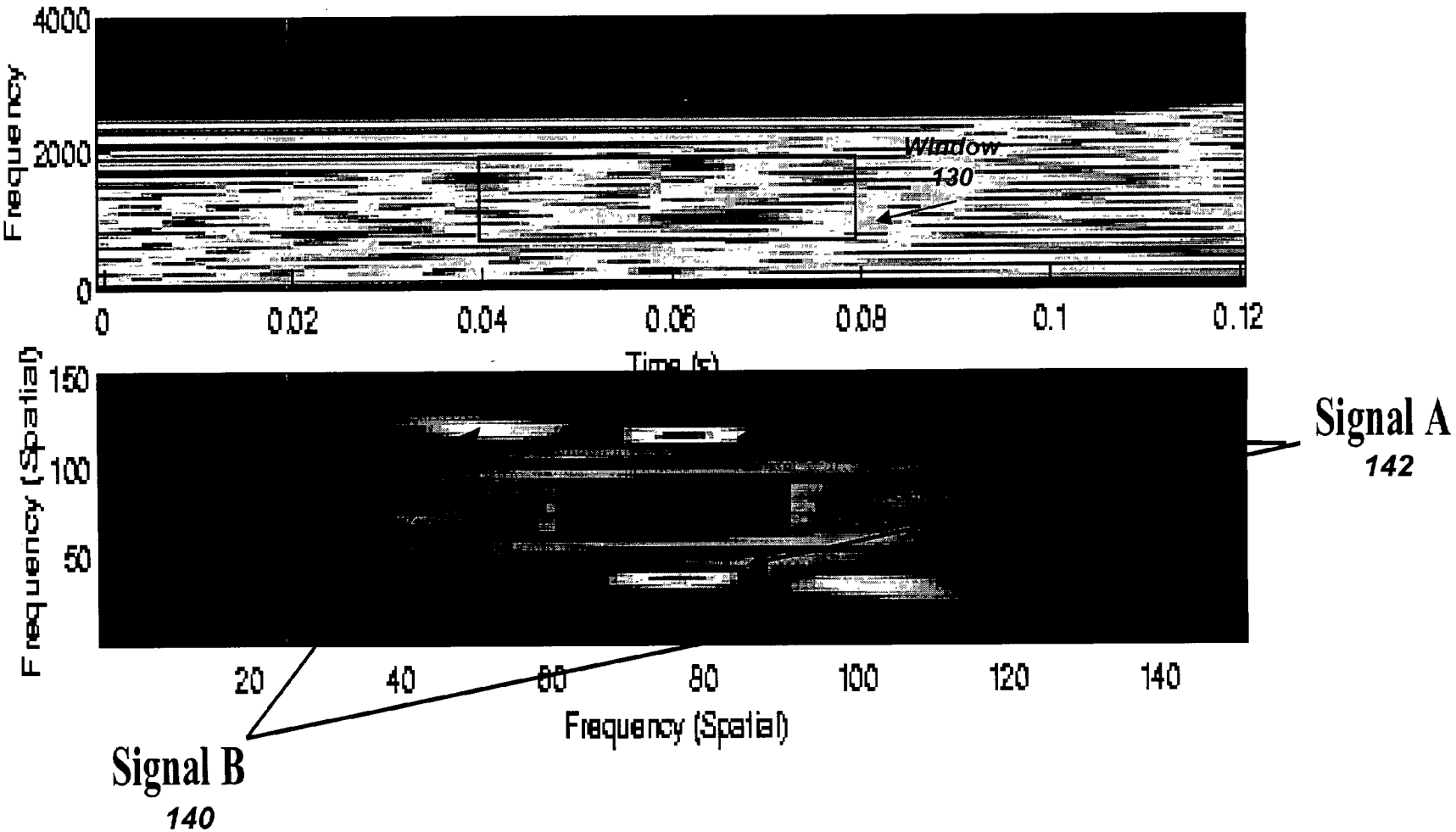
FIG. 5 illustrates a GCT analysis of a sum of harmonic complexes with 200-Hz fundamental (no FM) and 100-Hz starting fundamental (1000 Hz/s FM) spectrogram and a GCT of that windowed spectrogram.

FIG. 5 shows a GCT (bottom panel) and the speech used in its computation (top panel). The GCT (FIG. 5) is shown at a time instant where there is significant intersection of the harmonic trajectories under the 2-D window, with the FM sine-wave complex being of lower amplitude. Nevertheless, there is separability in the GCT. It illustrates a GCT analysis of a sum of harmonic complexes with 200-Hz fundamental (no FM) and 100-Hz starting fundamental (1000 Hz/s FM) spectrogram and a GCT of that windowed spectrogram.

In general, the spacing and angle of the line structure for a Signal A 142 differs from that of a Signal B 140, reflecting different pitch and rate of pitch change. Although the line structure of the two speech signals generally overlap in the spectrogram representation, the 2-D Fourier transform of the spectrogram separates the two overlapping harmonic sets and thus provides a basis for two-speaker pitch tracking.

Figure 6A:
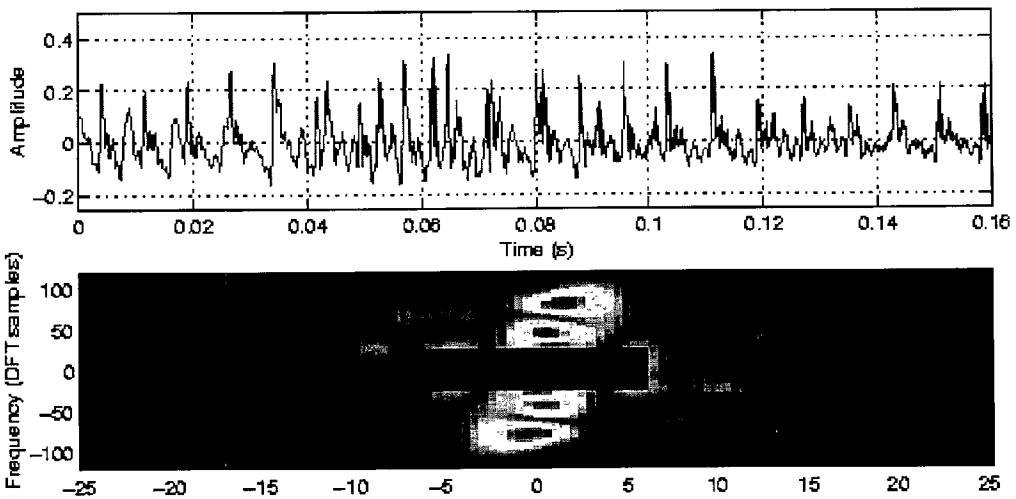
FIGS. 6A, 6B illustrate a separability property in the GCT of two summed all-voiced speech waveforms from a male and female speaker.
Figure 6B:
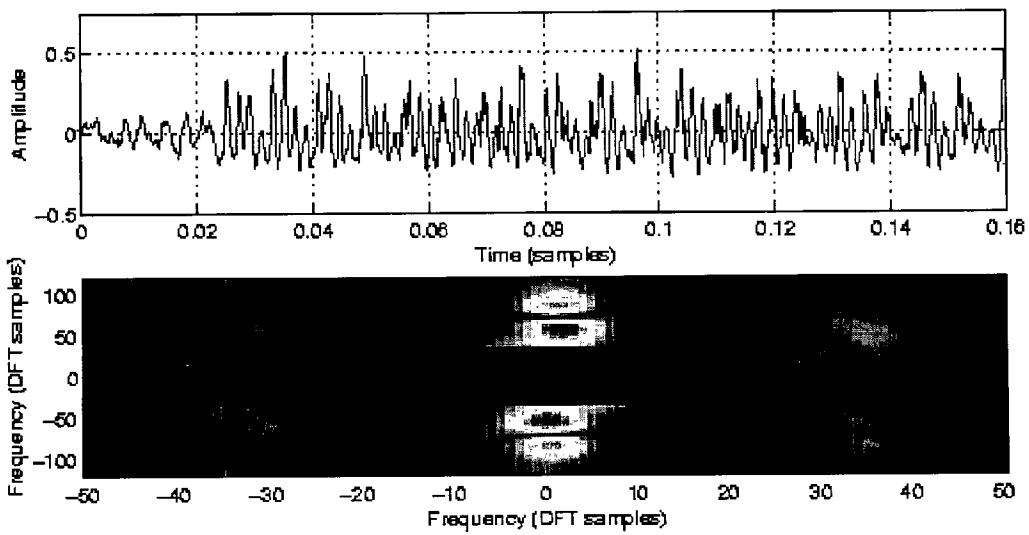

FIGS. 5 and 6A, 6B show examples of synthetic and real speech, respectively. The synthetic case (FIG. 5) consists of a harmonic complex with a 200-Hz fundamental and no FM (Signal A 142), added to a harmonic complex with a starting fundamental of 100 Hz with 1000 Hz/s FM (Signal B 140).

FIG. 6A, 6B shows a similar separability property in the GCT of two summed all-voiced speech waveforms from a male and female speaker. The upper component of FIGS. 6A and 6B show the speech signal in the region of the 2-D time-frequency window used in computing the GCT. The windowing strategies are similar to those used in the previous examples.

Figure 7:
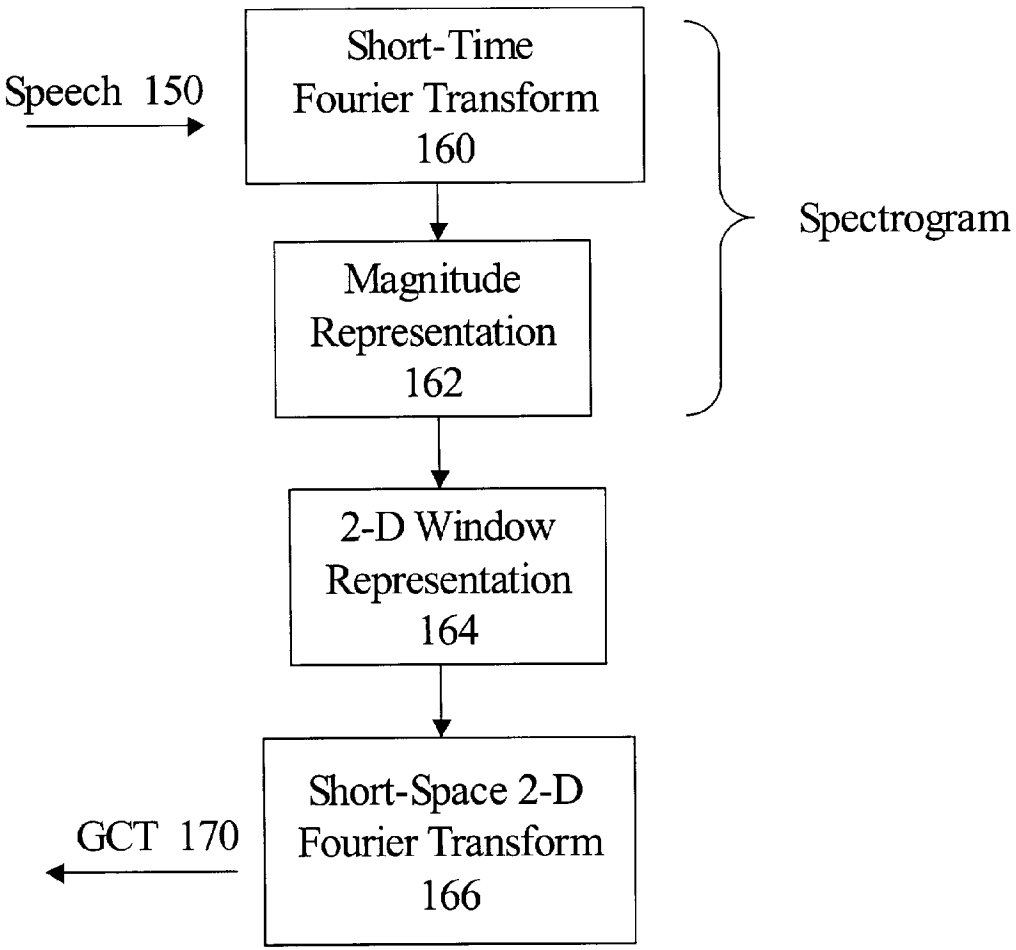
FIG. 7 is a flow diagram of components used in the computation of the GCT.

FIG. 7 is a flow diagram of components used in the computation of the GCT. Speech 150 is input to a short-time Fourier transform 160. The short-time Fourier transform 160 produces a magnitude representation 162, such as a spectrogram (e.g., FIG. 2A). A 2-D window representation 164 (e.g., FIG. 2B) is also produced. A short-space 2-D Fourier transform 166 is computed to produce the GCT (e.g., FIG. 2C) or compressed frequency-related representation 120. The GCT can also be complex, whereby the magnitude of the short-time Fourier transform is not computed. Making the GCT complex can provide advantages in the inversion process (for synthesis).

Figure 8:
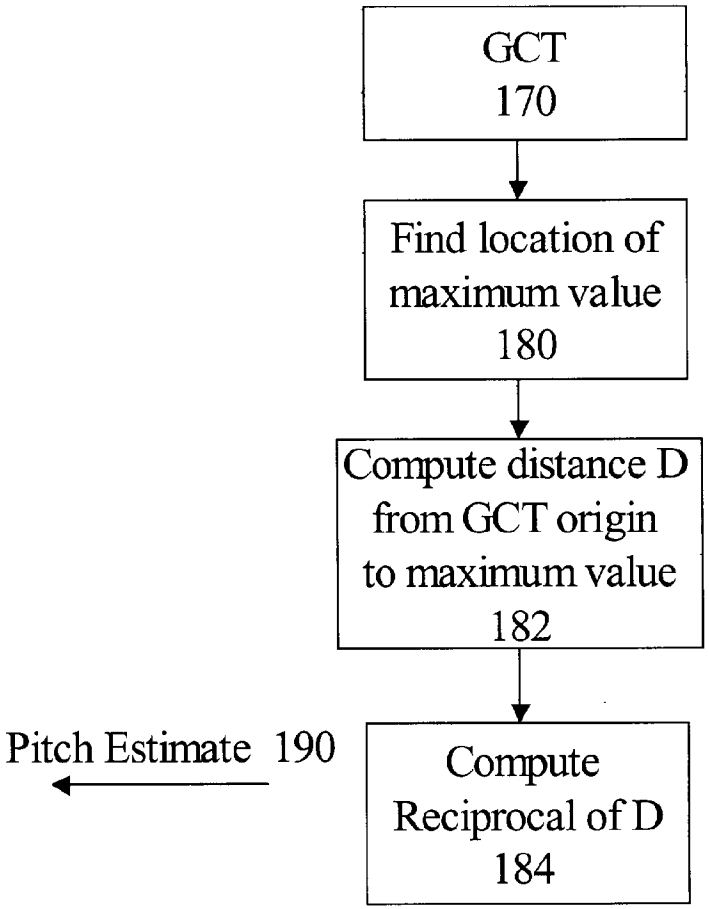
FIG. 8 is a flow diagram of components used in the computation of a GCT-based pitch estimation.

FIG. 8 is a flow diagram of components used in the computation of a GCT-based pitch estimation. A GCT 170 is analyzed to find the location of the maximum value (180). A distance D is computed from the GCT 170 origin to the maximum value (182). The reciprocal of D is then computed to produce a pitch estimate 190.

An embodiment of the present invention applies the short-space 2-D Fourier transform to a narrowband spectrogram of the speech signal, this 2-D transformation maps harmonically-related signal components to a concentrated entity in a new 2-D plane. The resulting "grating compression transform" (GCT) forms the basis of a pitch estimator that uses the radial distance to the largest peak of the GCT. The resulting pitch estimator is robust under white noise conditions and provides for two-speaker pitch estimation.

Figure 9:
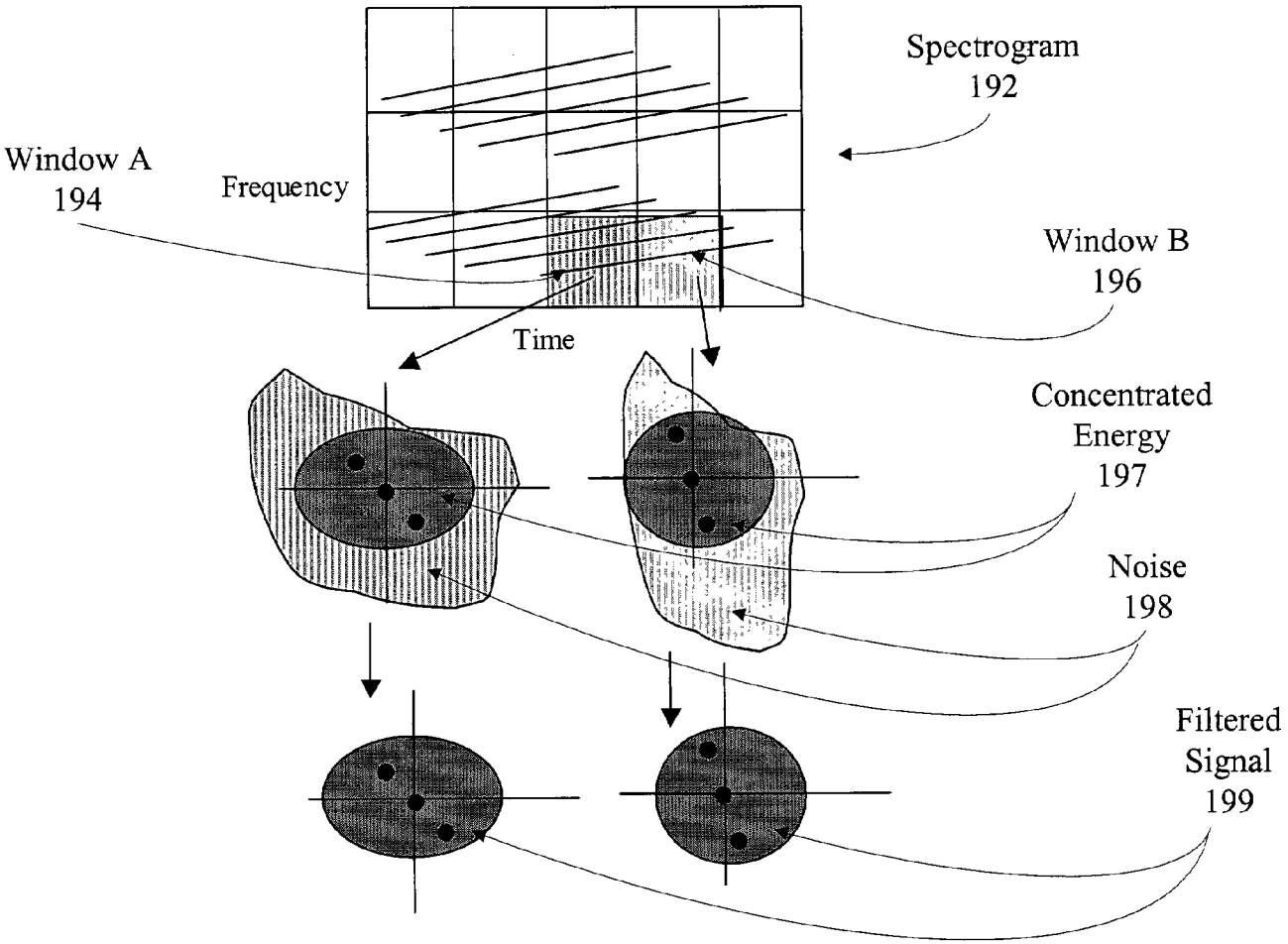
FIG. 9 is a diagram of an embodiment of the present invention using short-space filtering for reducing noise from an acoustic signal.

FIG. 9 is a diagram of an embodiment of the present invention using short-space filtering for reducing noise from an acoustic signal. The GCT maps a harmonic spectrogram 192, through Window A 194 and Window B 196, to concentrated energy 197 locations while additive noise 198 is scattered throughout the GCT plane. The GCT thus provides for performing noise reduction of acoustic signals. The noise 198 is filtered out, or suppressed, in the GCT plane and the GCT is inverted using an inverse 2-D Fourier transform to obtain an enhanced spectrogram (i.e., filtered signal 199). The operation can be applied over short-space regions of the spectrogram 192 and enhanced regions can be pieced, or "faded", back together. Using the enhanced spectrogram, an enhanced speech signal is obtained.

Figure 10:
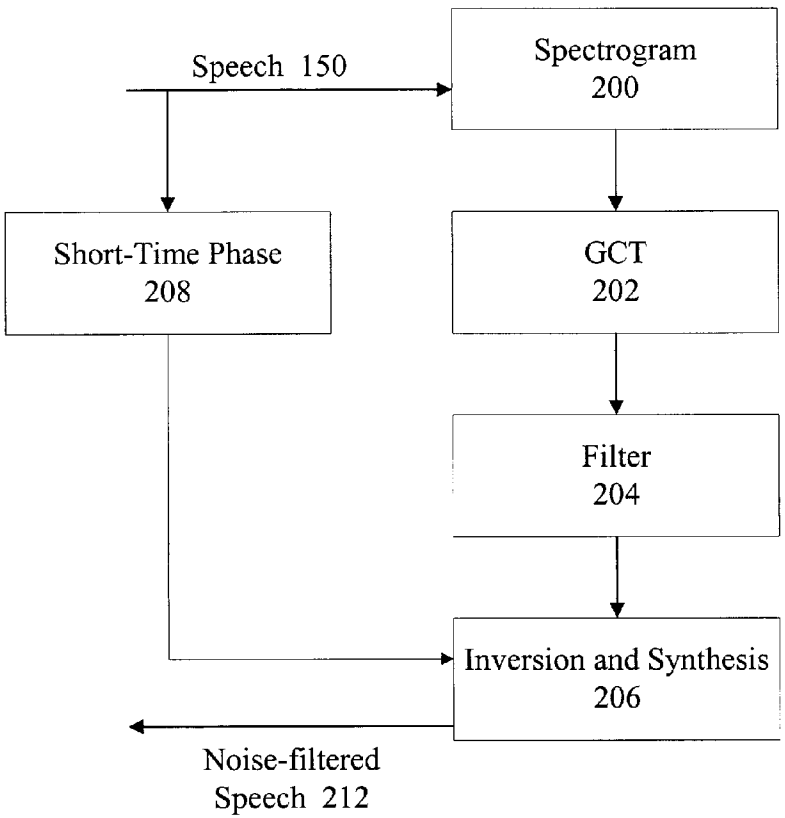
FIG. 10 is a flow diagram of a GCT-based algorithm for noise reduction using inversion and synthesis.

FIG. 10 is a flow diagram of a GCT-based algorithm for noise reduction using inversion and synthesis. In one embodiment of the present invention the original (noisy) phase of the short-time Fourier transform (STFT) analysis is combined with the enhanced magnitude-only spectrogram. An overlap-add signal recovery can then invert the resulting enhanced STFT and then overlap and add the resulting short-time segments. A speech signal 150 is sent through short-time phase 208 and the speech signal 150 is also used to produce a spectrogram 200. The spectrogram 200 is processed to produce GCT 202, which is filtered by filter 204. Inversion and synthesis 206 is then performed to produce noise-filtered speech 212.

Figure 11:
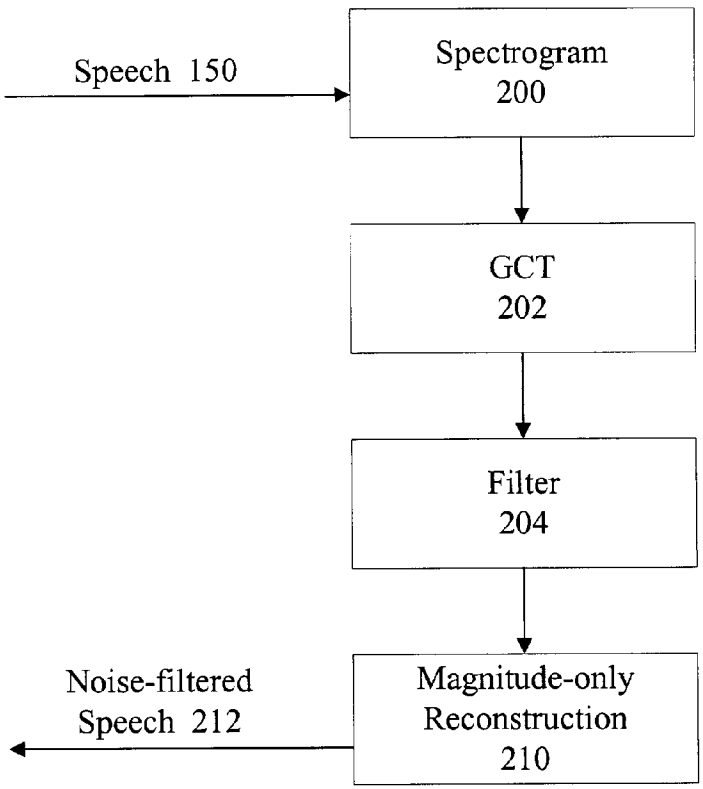
FIG. 11 is a flow diagram of a GCT-based algorithm for noise reduction using magnitude-only reconstruction.

FIG. 11 is a flow diagram of a GCT-based algorithm for noise reduction using magnitude-only reconstruction. Using magnitude-only reconstruction the same filtering scheme is used as described above, but rather than use of the original (noisy) phase of the acoustic signal in the synthesis, an iterative magnitude-only reconstruction is invoked, whereby short-time phase is estimated from the enhanced spectrogram. Example iterative magnitude-only reconstruction techniques are described in "Frequency Sampling Of The Short-time Fourier-transform Magnitude For Signal reconstruction" by T. F. Quatieri, S. H. Nawab and J. S. Lim published in the Journal of the Optical Society of America Vol. 73, page 1523, November 1983, and "Signal Reconstruction Form Short-Time Fourier Transform Magnitude" by S. Hamid Nawab, Thomas F. Quatieri and Jae S. Lim published in IEEE Transactions on Acoustics, Speech, And Signal Processing, Vol. ASSP-31, No. 4, August 1983, the teaching of which are herein incorporated by reference. A speech signal 150 is used to produce a spectrogram 200. The spectrogram 200 is processed to produce GCT 202, which is filtered by filter 204. A magnitude-only reconstruction 210 is then performed to produce noise-filtered speech 212.

Figure 12:
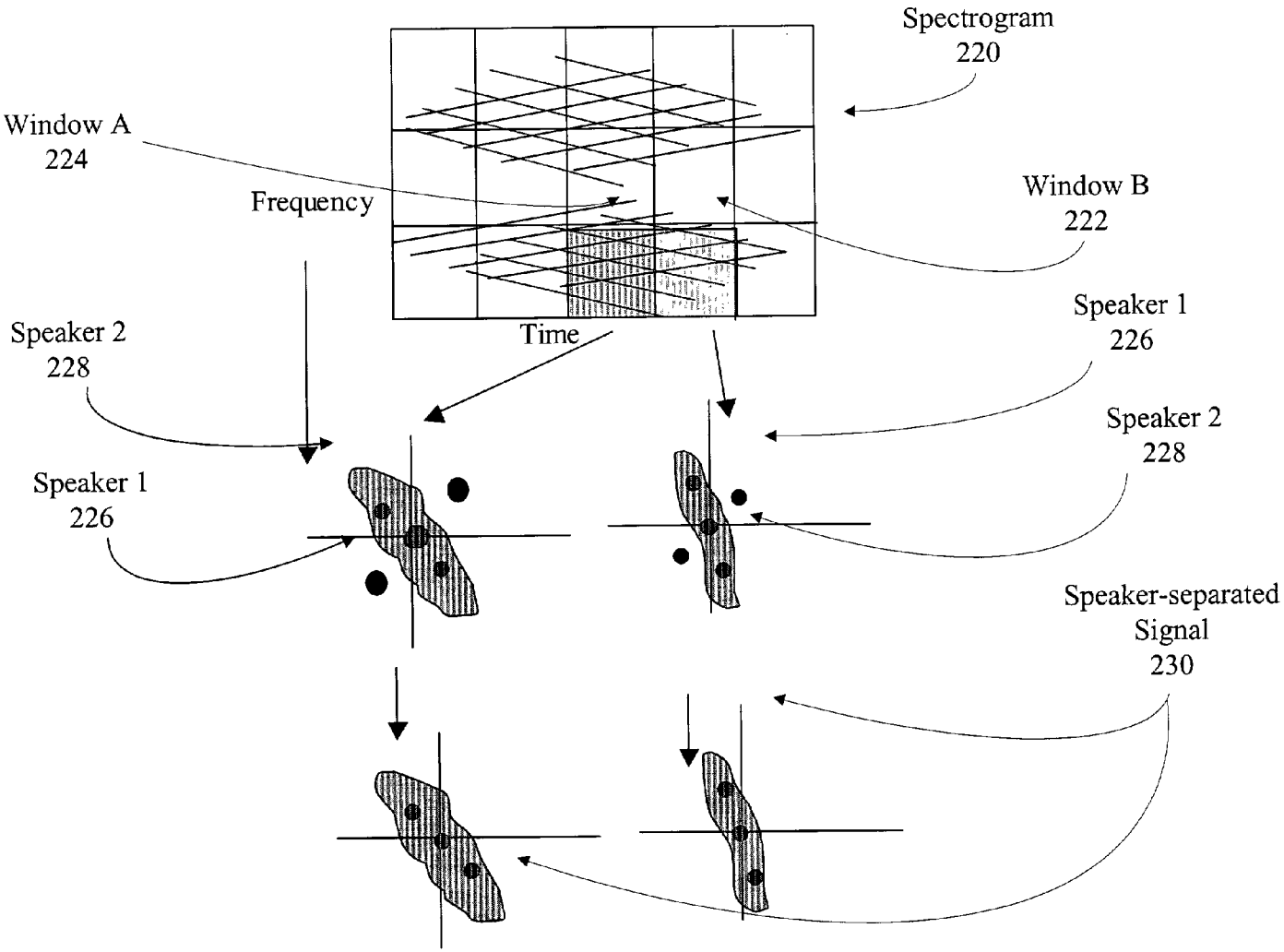
FIG. 12 is a diagram of short-space filtering of a two-speaker GCT for speaker separation.

FIG. 12 is a diagram of short-space filtering of a two-speaker GCT for speaker separation. The process of speaker separation is similar to that of noise reduction. A spectrogram 220 maps speech signals from two separate speakers. In this example, a first speaker's speech signals are represented by a series of parallel lines with a downward slope and a second speaker's speech signals are represented by a series of parallel lines with an upward slope. The GCT maps a harmonic spectrogram 220, through different windows, such as Window A 222 and Window B 224, to concentrated energy locations representing speaker 1 (226) and speaker 2 (228). The GCT maps the sum of two harmonic spectrograms to typically distinct concentrated energy locations in the GCT plane, thus providing a basis for providing a speaker-separated signal 230. The basic concept entails filtering out, or suppressing, unwanted speakers in the GCT plane and then inverting the GCT (using an inverse 2-D Fourier transform) to obtain an enhanced spectrogram. The operation can be applied over short-space regions of the spectrogram 220 and enhanced regions can be pieced, or "faded", back together. Using the enhanced spectrogram, an enhanced speech signal is obtained and used for recovering separate speech signals. The recovery of an enhanced speech signal can be obtained in a number of ways, one embodiment of the present invention uses the original (noisy) phase of the short-time Fourier transform (STFT) with phase used only at harmonics of the desired speaker as derived from multi-speaker pitch estimation. A second embodiment of the present invention approach uses iterative magnitude-only reconstruction whereby short-time phase is estimated from the enhanced spectrogram Example iterative magnitude-only reconstruction techniques are described in "Frequency Sampling Of The Short-time Fourier-transform Magnitude For Signal reconstruction" by T. F. Quatieri, S. H. Nawab and J. S. Lim published in the Journal of the Optical Society of America Vol. 73, page 1523, November 1983, and "Signal Reconstruction Form Short-Time Fourier Transform Magnitude" by S. Hamid Nawab, Thomas F. Quatieri and Jae S. Lim published in IEEE Transactions on Acoustics, Speech, And Signal Processing, Vol. ASSP-31, No. 4, August 1983, the teaching of which are herein incorporated by reference.

Figure 13:
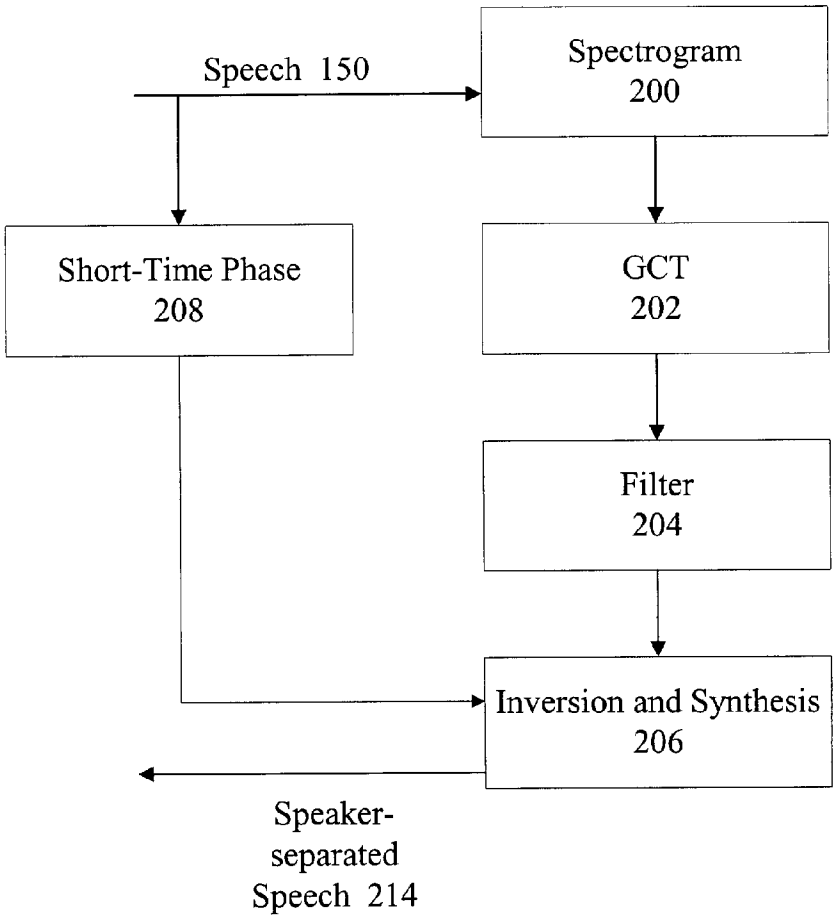
FIG. 13 is flow diagram for a GCT-based algorithm for speaker separation.

FIG. 13 is flow diagram for a GCT-based algorithm for speaker separation. A speech signal 150 is sent through a short-time phase 208 and the speech signal 150 is also used to produce a spectrogram 200. The spectrogram 200 is processed to produce GCT 202, which is filtered by filter 204. Inversion and synthesis 206 is then performed on the output of filter 204 and short-time phase 208 to produce a speaker-separated speech signal 214.

Figure 14:
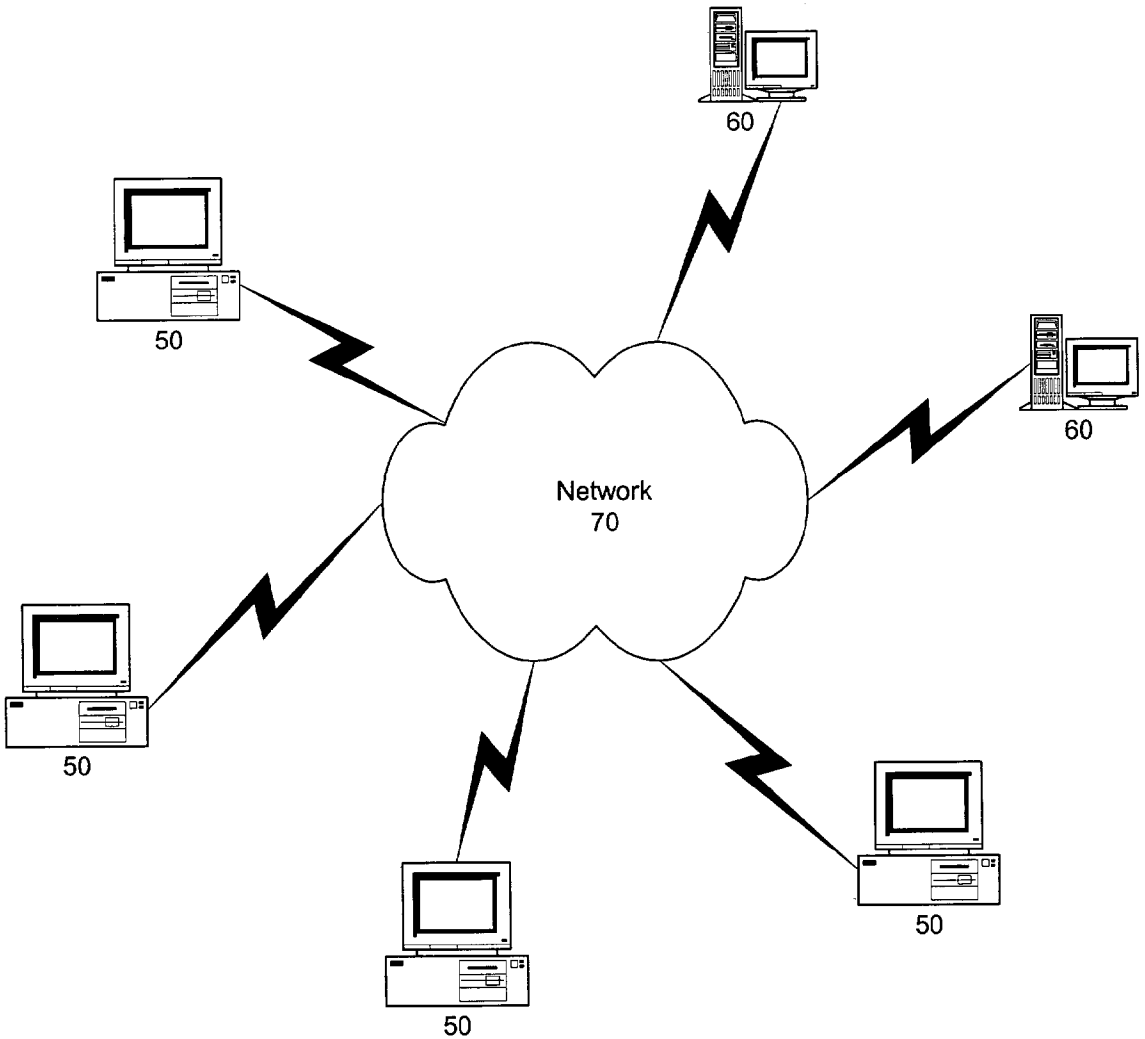
FIG. 14 is a diagram of a computer system on which an embodiment of the present invention is implemented.

FIG. 14 is a diagram of a computer system on which an embodiment of the present invention is implemented. Client computers 50 and server computers 60 provide processing, storage, and input/output devices for 2-D processing of acoustic signals. The client computers 50 can also be linked through a communications network 70 to other computing devices, including other client computers 50 and server computers 60. The communications network 70 can be part of the Internet, a worldwide collection of computers, networks and gateways that currently use the TCP/IP suite of protocols to communicate with one another. The Internet provides a backbone of high-speed data communication lines between major nodes or host computers, consisting of thousands of commercial, government, educational, and other computer networks, that route data and messages. In another embodiment of the present invention, 2-D processing of acoustic signals can be implemented on a stand-alone computer.

Figure 15:
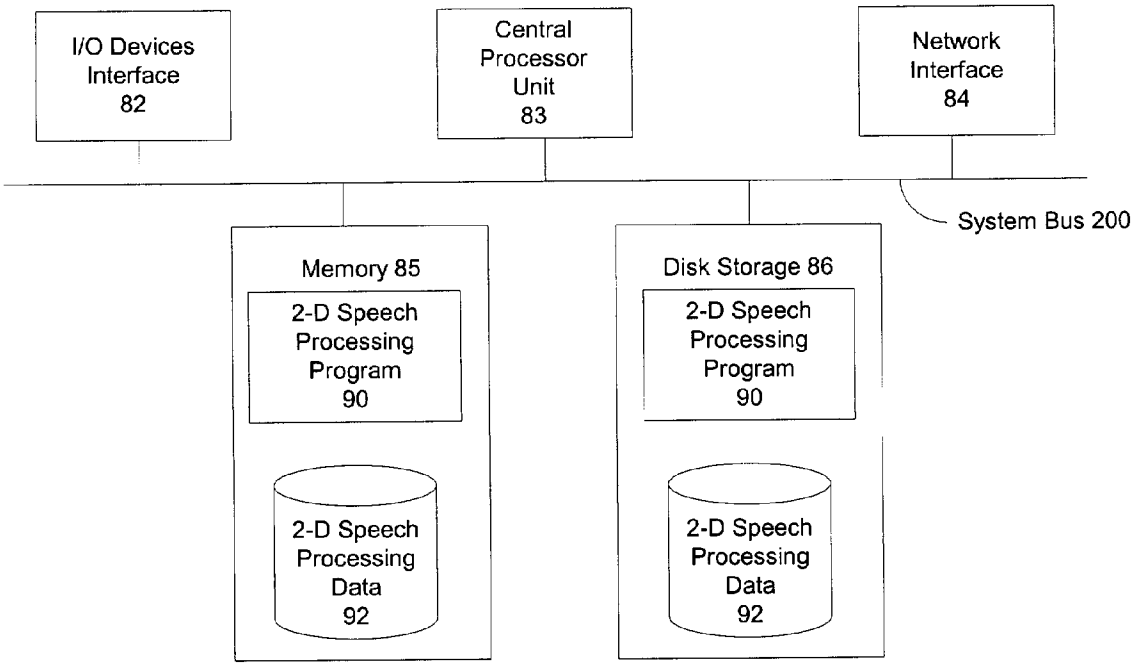
FIG. 15 is a diagram of the internal structure of a computer in the computer system of FIG. 14.

FIG. 15 is a diagram of the internal structure of a computer in the computer system of FIG. 14. Each computer contains a system bus 80, where a bus is a set of hardware lines used for data transfer among the components of a computer. A bus 80 is essentially a shared conduit that connects different elements of a computer system (e.g., processor, disk storage, memory, input/output ports, network ports, etc.) that enables the transfer of information between the elements. Attached to system bus 80 is an I/O device interface 82 for connecting various input and output devices (e.g., displays, printers, speakers, etc.) to the computer. A network interface 84 allows the computer to connect to various other devices attached to a network (e.g., network 70). A memory 85 provides volatile storage for computer software instructions for 2-D processing of acoustic signals (e.g., 2-D Speech Processing Program 90) and data (e.g., 2-D Speech Processing Data 92) used for 2-D processing of acoustic signals, which are used to implement an embodiment of the present invention. Disk storage 86 provides non-volatile storage for computer software instructions for computer software instructions for 2-D processing of acoustic signals and data used for 2-D processing of acoustic signals, which are used to implement an embodiment of the present invention. In other embodiments of the present invention the instructions and data are stored on other computer usable media, such as floppy-disks and CD-ROMs, or and propagated on communications signals. A central processor unit 83 is also attached to the system bus 80 and provides for the execution of computer instructions for computer software instructions for 2-D processing of acoustic signals and data used for 2-D processing of acoustic signals, thus allowing the computer to perform 2-D processing of acoustic signals to estimate pitch, reduce noise and provide speaker separation.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of processing an acoustic signal, comprising:

preparing a frequency-related representation of the acoustic signal over time;

computing a two dimensional transform of a two dimensional localized portion of the first frequency-related representation that is less tna an entire frequency region of the first frequency-related representation to provide a two dimensional compressed frequency-related representation with respect to the two dimensional localized portion within the first frequency-related representation; and processing the two dimensional compressed frequency-related representation.

2. The method of claim 1 wherein the acoustic signal is a speech signal; and the step of processing determines a pitch of the speech signal.

3. The method of claim 2 wherein the pitch of the speech signal is determined from an inverse of distance between an impulse peak and an origin in the two dimensional compressed frequency-related representation.

4. The method of claim 1 wherein the two dimensional localized region within the first frequency-related representation of the acoustic signal is characterized by substantially linear pitch, corresponding to substantially parallel harmonics.

5. The method of claim 1 wherein the step of processing further comprises filtering noise from the two dimensional compressed frequency-related representation.

6. The method of claim 1 wherein the step of processing distinguishes plural sources within the acoustic signal by filtering the two dimensional compressed frequency-related representation and performing an inverse transform.

7. The method of claim 1 wherein computing the two dimensional transform comprises:

converting a two dimensional line structure, of the frequency-related representation, into an impulse in the two dimensional compressed frequency-related representation.

8. The method of claim 7 wherein a slope of a line between the impulse and an

9. The method of claim 1 wherein computing the two dimensional transform comprises:

converting a two dimensional line structure, of the frequency-related representation, into an impulse in the two dimensional compressed frequency-related representation.

10. The method of claim 9 wherein the first two dimensional transform comprises a spectral analysis, a wavelet transform, an auditory transform or a Wigner transform.

11. The method of claim 1 wherein the frequency-related representation of the acoustic signal is produced by a two dimensional transform of the acoustic signal.

12. The method of claim 11 wherein the two dimensional transform comprises a spectral analysis, a wavelet transform, an auditory transform or a Wigner transform.

13. An apparatus for processing an acoustic signal, comprising:

a first transformer providing a frequency-related representation of the acoustic signal over time;

a two-dimensional transformer providing a two dimensional compressed frequency-related representation of the frequency-related representation over time; and a processor processing the two dimensional compressed frequency-related representation.

14. The apparatus of claim 13 wherein the acoustic signal is a speech signal; and the processor determines a pitch of the speech signal.

15. The apparatus of claim 14 wherein the pitch of the speech signal is determined from an inverse of distance between an impulse peak and an origin in the two dimensional compressed frequency-related representation.

16. The apparatus of claim 13 wherein the processor further comprises a noise filter.

17. The apparatus of claim 6 wherein a plurality of two dimensional windows within the portion of the first frequency-related representation is used to perform a multiband analysis.

18. The apparatus of claim 13 wherein the two dimensional transform comprises a spectral analysis, a wavelet transform, an auditory transform or a Wigner transform.

19. The apparatus of claim 13 wherein the two dimensional compressed frequency-related representation is provided by converting a two dimensional line structure, of the frequency-related representation, into an impulse in the two dimensional compressed frequency-related representation.

20. The apparatus of claim 19 wherein a slope of a line between the impulse and an origin is indicative of a rate of change of pitch.

21. The apparatus of claim 13 wherein the first transformer is one dimensional.

22. The apparatus of claim 13 wherein the frequency-related representation of the acoustic signal is produced by a two dimensional transform of the acoustic signal.

23. The apparatus of claim 13 wherein the first frequency-related representation of the acoustic signal is produced by a first two dimensional transform of the acoustic signal.

24. The apparatus of claim 23 wherein the first two dimensional transform comprises a spectral analysis, a wavelet transform, an auditory transform or a Wigner transform.

25. The apparatus of claim 13 wherein the two dimensional localized portion is defined by non-zero frequencies.

26. The apparatus of claim 13 wherein the two-dimensional transformer is further configured to provide a plurality of two dimensional compressed frequency-related representations of a plurality of two dimensional localized portions.

27. The computer program product of claim 26 wherein a plurality of two dimensional windows within the frequency-related representation is used to perform a multiband analysis.

28. The computer program product of claim 23 wherein the acoustic signal is a speech signal; and the processing instructions determine a pitch of the speech signal.

29. The computer program product of claim 28 wherein the pitch of the speech signalis determined from an inverse of distance between an impulse peak and an origin in the two dimensional compressed frequency-related representation.

30. The computer program product of claim 28 wherein the two dimensional localized region within the first frequency-related representation is characterized by substantially linear pitch, corresponding to substantially parallel harmonics.

31. The computer program product of claim 30 wherein a plurality of two dimensional windows within the portion of the first frequency-related representation is used to perform a multiband analysis.

32. The computer program product of claim 31 wherein a slope of a line between the impulse and an origin is indicative of a rate of change of pitch.

33. The computer program product of claim 27 wherein the instructions to process distinguish plural sources within the acoustic signal by filtering the two dimensional compressed frequency-related representation and performing an inverse transform.

34. An apparatus for processing an acoustic signal comprising:

a one dimensional transforming means for providing a frequency-related representation of an acoustic signal over time;

a two dimensional transforming means for providing a two dimensional compressed frequency-related representation of the frequency-related representation over time; and a processing means for processing the two dimensional compressed frequency-related representation.

35. The computer program product of claim 34 wherein a slope of a line between the impulse and an origin is indicative of a rate of change of pitch.

36. The computer program product of claim 27 wherein the first frequency-related representation of the acoustic signal is produced by a first two dimensional transform of the acoustic signal.

37. The computer program product of claim 36 wherein the first two dimensional transform comprises a spectral analysis, a wavelet transform, an auditory transform or a Wigner transform.

38. The computer program of claim 27 further including instructions to compute a plurality of two dimensional transforms of a plurality of two dimensional localized portions.

39. The computer program of claim 27 wherein the two dimensional localized portion is defined by non-zero frequencies.

40. An apparatus for processing an acoustic signal comprising:

a one dimensional transforming means for providing a first frequency-related representation of an acoustic signal over time;

a two dimensional transforming means for providing a two dimensional compressed frequency-related representation of a two dimensional portion of the first frequency-related representation that is less than an entire frequency region of the frequency-related representation over time with respect to the two dimensional localized portion within the first frequency-related representation; and a processing means for processing the two dimensional compressed frequency-related representation.

* * * * *

UNITED STATES PATENT AND TRADEMARK OFFICE

CERTIFICATE OF CORRECTION

PATENT NO. : 7,574,352 B2
APPLICATION NO. : 10/244086
DATED : August 11, 2009
INVENTOR(S) : Thomas F. Quatieri, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1080 days.

Signed and Sealed this

Seventh Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,574,352 B2
APPLICATION NO. : 10/244086
DATED : August 11, 2009
INVENTOR(S) : Thomas F. Quatieri, Jr.

It is certified that error appears in the above-identified patent and that said Letters Patent is hereby corrected as shown below:

In Claim 1, column 10, line 7, delete "tna" and insert --than--;

In Claim 8, column 10, line 46, after "an" insert --origin is indicative of a rate of change of pitch--;

In column 10, lines 46-51, delete all of claim 9 and insert

--9. The apparatus of Claim 13 wherein the two dimensional localized region within the first frequency-related representation is characterized by substantially linear pitch, corresponding to substantially parallel harmonics.--;

In Claim 13, column 11, lines 2-3, between "of" and "the" insert --a two dimensional localized portion of the first frequency-related representation that is less than an entire frequency region of--, and line 4, between "time" and ";" insert --with respect to the two dimensional localized portion within the first frequency-related representation--;

In Column 11, lines 20-23, delete all of Claim 18 and insert

--18. The apparatus of Claim 13 wherein the processor distinguishes plural sources within the acoustic signal by filtering the two dimensional compressed frequency-related representation and performing an inverse transform.--;

Signed and Sealed this
Tenth Day of May, 2011

David J. Kappos

David J. Kappos
*Director of the United States Patent and Trademark Office*

In Column 11, lines 34-36, delete all of Claim 22 and insert

--22. A computer program product comprising:

a computer usable medium for processing an acoustic signal;

a set of computer program instructions embodied on the computer usable medium, including instructions to:

prepare a first frequency-related representation of the acoustic signal over time;

compute a two dimensional transform of a two dimensional localized portion of the first frequency-related representation that is less than an entire frequency region of the first frequency-related representation to provide a two dimensional compressed frequency-related representation with respect to the two dimensional localized portion within the first frequency-related representation; and process the two dimensional compressed frequency-related representation.--;

In Column 11, lines 50-53, delete all of Claim 27 and insert

--27. The computer program product of Claim 22 wherein the instructions to process comprise instructions to filter noise from the acoustic signal.--;

In Claim 28, column 11, line 54, delete “23” and insert --22--;

In Claim 29, column 11, line 59, insert a space between “signal” and “is”;

In Column 12, lines 10-12, delete all of Claim 32 and insert

--32. The computer program product of claim 22 wherein the instructions to compute the two dimensional compressed frequency-related representation is provided by converting a two dimensional line structure, of the frequency-related representation, into an impulse in the two dimensional compressed frequency-related representation.--;

In Column 12, lines 18-28, delete all of Claim 34 and insert

--34. The method of Claim 1 wherein the two dimensional localized portion is defined by non-zero frequencies.--.